US010479642B2

(12) United States Patent
Tang

(10) Patent No.: US 10,479,642 B2
(45) Date of Patent: Nov. 19, 2019

(54) PULL-OUT TYPE CORD WINDING MODULE

(71) Applicant: QINGDAO GOERTEK TECHNOLOGY CO., LTD., Qingdao (CN)

(72) Inventor: Mingjun Tang, Qingdao (CN)

(73) Assignee: QINGDAO GOERTEK TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 16/074,731

(22) PCT Filed: Aug. 12, 2016

(86) PCT No.: PCT/CN2016/094927
§ 371 (c)(1),
(2) Date: Aug. 1, 2018

(87) PCT Pub. No.: WO2018/014391
PCT Pub. Date: Jan. 25, 2018

(65) Prior Publication Data

US 2019/0010014 A1 Jan. 10, 2019

(30) Foreign Application Priority Data

Jul. 22, 2016 (CN) ..... 2016 1 0586990

(51) Int. Cl.
*B65H 75/44* (2006.01)
*B65H 75/48* (2006.01)

(52) U.S. Cl.
CPC ..... *B65H 75/4402* (2013.01); *B65H 75/4418* (2013.01); *B65H 75/4434* (2013.01);
(Continued)

(58) Field of Classification Search
CPC ..... B65H 75/4402; B65H 75/4418; B65H 75/486; B65H 75/4434; B65H 75/4471; B65H 2701/3919
See application file for complete search history.

(56) References Cited

U.S. PATENT DOCUMENTS 6,135,254 A * 10/2000 Liao ..... H02G 11/02 191/12.2 R
6,644,582 B1 11/2003 Liao
(Continued)

FOREIGN PATENT DOCUMENTS

CN 2617745 Y 5/2004
CN 2740576 Y 11/2005
(Continued)

OTHER PUBLICATIONS

Chinese First Office Action dated Mar. 30, 2017 for Application No. 201610586990.0.
(Continued)

*Primary Examiner* — William A. Rivera
(74) *Attorney, Agent, or Firm* — Moser Taboada

(57) ABSTRACT

A pull-out type cord winding module, comprising a rotary wheel (6) which a cord (7) is wound on and which is connected with a coil spring (5), and a stopper mechanism working cooperatively with the rotary wheel (6) and including a functional rail, a ball (3) and a rolling assisting device. The functional rail comprises a locking rail, a communicating rail (25) and annular rails (21, 22) which are connected, groove-shaped and arranged around an outer circumference of the rotary wheel (6). A guide groove (91) is provided on the rolling assisting device, and two ends of the guide groove (91) are located at the upper and lower sides of the outer circumference of the rotary wheel (6) respectively. The guide groove (91) cooperates with the functional rail to hold
(Continued)

the ball (3). When the rotary wheel (6) rotates, the ball (3) rolls in the functional rail to lock or unlock rotation of the rotary wheel (6).

10 Claims, 3 Drawing Sheets

(52) U.S. Cl.
CPC ..... *B65H 75/4471* (2013.01); *B65H 75/486* (2013.01); *B65H 2701/3919* (2013.01)

(56) References Cited

U.S. PATENT DOCUMENTS

| | | | | |
|---|---|---|---|---|
| 6,834,820 | B2 * | 12/2004 | Wei | B65H 75/4449 191/12.2 R |
| 7,784,727 | B1 | 8/2010 | Liao | |
| 7,909,281 | B2 | 3/2011 | Liao | |
| 2010/0314479 | A1 * | 12/2010 | Kish | A01K 27/004 242/376 |
| 2018/0093852 | A1 * | 4/2018 | Morey | B65H 75/4452 |

FOREIGN PATENT DOCUMENTS

| | | | |
|---|---|---|---|
| CN | 201113360 | Y | 9/2008 |
| CN | 101373868 | A | 2/2009 |
| CN | 201351067 | Y | 11/2009 |
| CN | 201890674 | U | 7/2011 |
| CN | 203558655 | U | 4/2014 |
| CN | 104301825 | A | 1/2015 |
| CN | 205892372 | U | 1/2017 |
| CN | 205953226 | U | 2/2017 |
| DE | 2610916 | A1 | 9/1977 |

OTHER PUBLICATIONS

International Search Report and Written Opinion dated May 2, 2017 for PCT Application No. PCT/CN2016/094927.
Chinese Second Office Action dated Oct. 11, 2017 for Application No. 201610586990.0.

* cited by examiner

PULL-OUT TYPE CORD WINDING MODULE

CROSS REFERENCE TO RELATED APPLICATIONS

This application is a U.S. National Stage entry under 35 U.S.C. § 371 based on International Application No. PCT/CN2016/094927, filed on Dec. 8, 2016, which was published under PCT Article 21(2) and which claims priority to Chinese Patent Application No. 201610586990.0, filed on Jul. 22, 2016. The disclosure of the priority applications are hereby incorporated herein in their entirety by reference.

TECHNICAL FIELD

The present disclosure relates to a cord winding module, and more specifically to a pull-out type cord winding module.

BACKGROUND

Auxiliary devices having cords, such as earphones, mice, keyboards, etc., are used in many electronic devices. In order to use more conveniently, cord winding modules have been increasingly provided in these auxiliary devices for receiving cords or signal wires. The cord winding module typically comprises a rotary wheel, a coil spring and a stopper mechanism. The cord is wound on the rotary wheel, and can be automatically retracted under the elastic restoring force of the coil spring. In the retracting process, the stopper mechanism can prevent the rotary wheel from rotating and stop the retracting of the cord, so that a suitable length of the cord can be reserved without retraction.

There are many types of stopper mechanisms in the prior art, one of which is a ball-rail type. A rail wheel is provided in cooperation with the rotary wheel, and a rail for the moving of a ball is provided on the end surface (the surface perpendicular to the rotating shaft) of the rail wheel. This design will inevitably increase the thickness of the cord winding module in the direction of the rotating shaft and is not suitable for products having a small thickness.

SUMMARY

In view of the above problems, the present disclosure provides a pull-out type cord winding module to solve the problems of conventional cord winding modules that the thickness in the direction of the rotating shaft is large and the retracting and pulling-out of the cord are not smooth.

To achieve the above purpose, the technical solutions of the present disclosure are as follows.

The present disclosure provides a pull-out type cord winding module, comprising a rotary wheel which a cord is wound on and which is connected with a coil spring, and a stopper mechanism working cooperatively with the rotary wheel and including a functional rail, a ball and a rolling assisting device;

the functional rail comprises a locking rail, a communicating rail and annular rails, the locking rail, the communicating rail and the annular rails are connected, groove-shaped and arranged around an outer circumference of the rotary wheel;

a guide groove is provided on the rolling assisting device, and two ends of the guide groove are located at upper and lower sides of the outer circumference of the rotary wheel respectively;

the guide groove cooperates with the functional rail to hold the ball; and when the rotary wheel rotates, the ball rolls in the functional rail to lock or unlock rotation of the rotary wheel.

In some embodiments, the functional rail is directly disposed on an outer circumferential surface of the rotary wheel;

or, a rail wheel is sleeved on the rotary wheel, the functional rail is arranged on the outer circumferential surface of the rail wheel, and the rail wheel is combined with the rotary wheel by clamping;

or, the rotary wheel is provided with a coil spring receiving groove, the coil spring receiving groove is provided with a cover, the functional rail is arranged on the outer circumferential surface of the cover, and the cover is combined with the rotary wheel by clamping.

In some embodiments, the pull-out type cord winding module further comprises an upper fixing cover and a lower fixing cover, the upper fixing cover constitutes the rolling assisting device, an elastic arm is provided on the upper fixing cover, the guide groove is disposed on the elastic arm; and the guide groove has a linear shape or an arc shape.

In some embodiments, the number of the annular rails is two and the two annular rails are located at the upper and lower sides of the outer circumference of the rotary wheel respectively;

the number of the locking rail and the number of the communicating rail are both at least two, the locking rails and the communicating rails are disposed alternately and evenly between two annular rails and connected with the two annular rails; and the annular rails comprise a retracting rail and an extending rail, and the height of the retracting rail is lower than that of the extending rail.

In some embodiments, the annular rails comprise an upper annular rail and a lower annular rail;

the locking rail has a "<" shape, and comprises an upper locking rail and a lower locking rail, and the ball is locked by a corner of the "<" shape; and the communicating rail is inclined and the direction of inclination is the same as the direction of the lower locking rail.

In some embodiments, a smooth guiding segment lower than the lower annular rail is provided at a junction between the lower locking rail and the lower annular rail;

protrusions are provided at the lower locking rail and the corner, and at a junction between the upper locking rail and the upper annular rail, respectively; and the protrusions allow merely one-way rolling of the ball in sequence along the lower annular rail, the lower locking rail, the upper locking rail and the upper annular rail.

In some embodiments, a smooth guiding segment lower than the upper annular rail is provided at a junction between the communicating rail and the upper annular rail;

a protrusion is provided at a junction between the communicating rail and the lower annular rail; and the protrusion allows merely one-way rolling of the ball in sequence along the upper annular rail, the communicating rail and the lower annular rail.

In some embodiments, when the cord is pulled outward, the rotary wheel rotates forward and tightens the coil spring, and the ball keeps rolling in the lower annular rail; or, the ball enters the lower annular rail from the upper annular rail via the communicating rail, and keeps rolling in the lower annular rail; and when the pulling of the cord is stopped, the coil spring drives the rotary wheel to rotate backward, the ball enters the locking rail from the lower annular rail and is stuck at the corner to prevent the rotary wheel from rotating backward, and the rotation of the rotary wheel is locked.

In some embodiments, when the cord is pulled outward again by a predetermined distance, the rotary wheel rotates forward, the ball enters the upper annular rail from the locking rail, and the rotation of the rotary wheel is unlocked; at this point the cord is released, the ball keeps rolling in the upper annular rail, and the rotary wheel retracts the cord;

or, when the cord is continuously pulled outward again, the rotary wheel rotates forward, and the ball enters the upper annular rail from the locking rail and then enters the lower annular rail via the communicating rail and keeps rolling in the lower annular rail.

In some embodiments, an axial protrusion is provided on an upper end surface of the cover as a rotating shaft, and a circular hole for matching is provided on the rolling assisting device.

In conclusion, the pull-out type cord winding module of the present disclosure has the following advantages:

In the present disclosure, the rails are arranged around the outer circumference of the rotary wheel, and compared with arranging the rails on the end surface of the rotary wheel, the thickness of the cord winding module in the direction of the rotating shaft is reduced, so the cord winding module is suitable for products having a small thickness.

In the present disclosure, the two annular rails are of a whole circular ring shape, the resistance is small, and the rolling of the ball is smooth, which facilitates the extending and retracting of the cord.

In the present disclosure, the two annular rails comprise a retracting rail and an extending rail, and the height of the retracting rail is lower than that of the extending rail, so the rolling resistance of the ball in the retracting rail is minimal. Since the retracting of the cord is automatically performed by the elastic restoring force of the coil spring, this design facilitates the smooth retracting of the cord.

BRIEF DESCRIPTION OF THE DRAWINGS

FIG. 5 (*b*) is a top view of the cover of the coil spring receiving groove;

FIG. 5 (*c*) is a cross section view taken along the line A-A of FIG. 5 (*a*); and FIG. 5 (*d*) is a cross section view taken along the line B-B of FIG. 5 (*b*).

DETAILED DESCRIPTION

Figure 1:
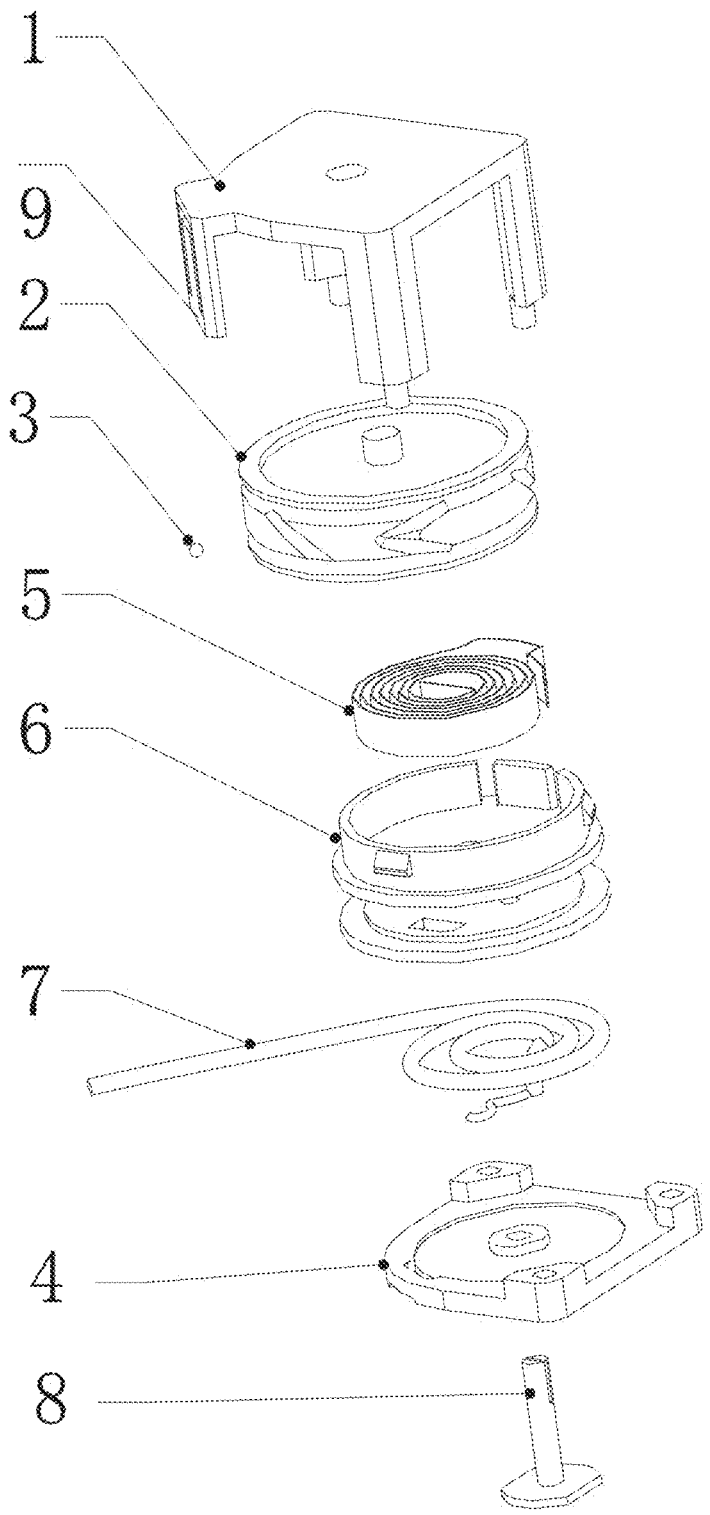
FIG. 1 is an exploded view of a pull-out type cord winding module according to a first embodiment of the present disclosure.

In order to make the objectives, technical solutions and advantages of the present disclosure clearer, the present disclosure is further described in detail with reference to the accompanying drawings and the embodiments.

First Embodiment

As jointly shown in FIG. 1 to FIG. 4, the present embodiment provides a pull-out type cord winding module. The pull-out type cord winding module comprises a rotary wheel 6 on which a cord 7 is wound and a stopper mechanism working cooperatively with the rotary wheel 6. The rotary wheel 6 can rotate around a rotating shaft 8, and is connected with a coil spring 5. The stopper mechanism comprises a functional rail, a ball 3 and a rolling assisting device. The functional rail comprises a locking rail, a communicating rail 25 and annular rails 21, 22, and these three rails are connected, groove-shaped and arranged around the outer circumference of the rotary wheel 6 by means of a cover 2. The ball 3 is arranged in the functional rail. In the present embodiment, the rails are arranged around the outer circumference of the rotary wheel 6, and compared with arranging the rails on the end surface of the rotary wheel 6, the thickness of the cord winding module in the direction of the rotating shaft 8 is reduced, so the pull-out type cord winding module is suitable for products having a small thickness.

The rolling assisting device is provided outside the rotary wheel 6. A guide groove 91 is provided on the rolling assisting device. Two ends of the guide groove 91 are located at the upper and lower sides of the outer circumference of the rotary wheel 6 respectively. The guide groove 91 cooperates with the functional rail to hold the ball 3. When the rotary wheel 6 rotates, the ball 3 rolls in the functional rail to lock or unlock rotation of the rotary wheel 6.

In the present embodiment, the pull-out type cord winding module further comprises an upper fixing cover 1 and a lower fixing cover 4. The upper fixing cover 1 constitutes the rolling assisting device. An elastic arm 9 is provided on the upper fixing cover 1. The guide groove 91 is disposed on the elastic arm 9. The guide groove 91 has a linear shape or an arc shape. When the guide groove 91 has an arc shape, compared with the linear guide groove 91, the contact area between the ball 3 and the guide groove 91 when the ball 3 rotates in the guide groove 91 is larger, which facilitates the rolling of the ball 3 in the guide groove 91.

Figure 2:
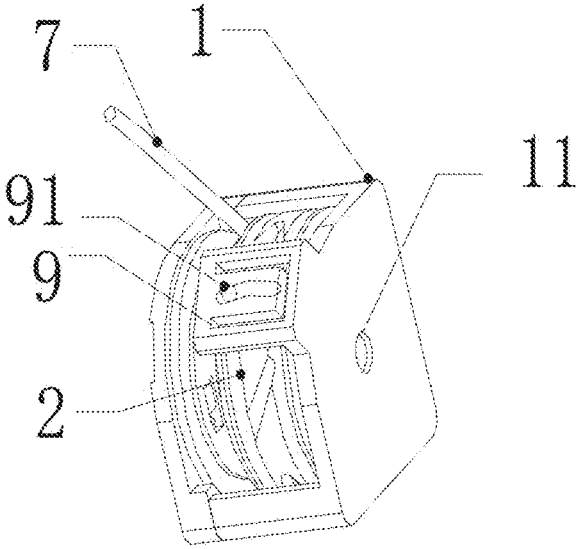
FIG. 2 is an assembly view of a pull-out type cord winding module according to a first embodiment of the present disclosure.
Figure 3:
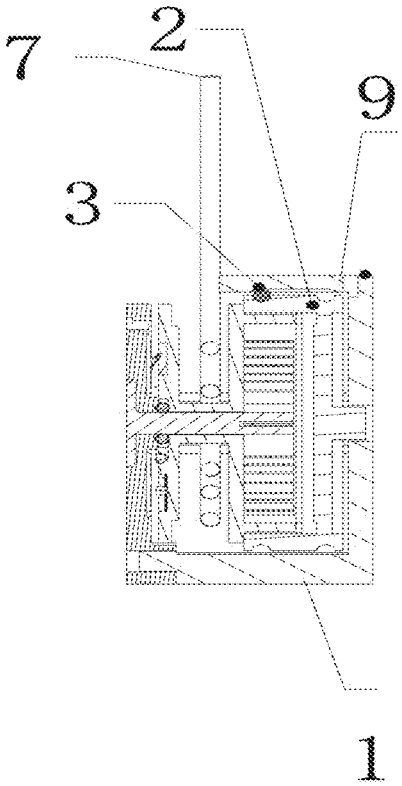
FIG. 3 is a cross section view of a pull-out type cord winding module according to a first embodiment of the present disclosure.
Figure 4:
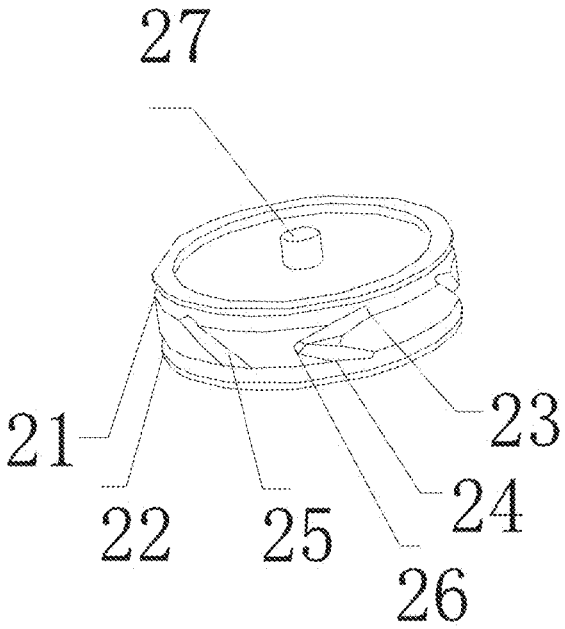
FIG. 4 is a perspective view of the cover of the coil spring receiving groove.

As shown in FIG. 2 to FIG. 4, the elastic arm 9 can be deformed by the application of a force. The elastic arm 9 can be deformed outward under the action of the pushing force of the ball 3, which facilitates the rolling of the ball 3 in the three different rails and thus improves the rolling smoothness of the ball 3, and also ensures the gripping force of the ball 3 and thus improves the rolling stability of the ball 3.

The rotary wheel 6 is provided with a coil spring receiving groove, the coil spring receiving groove is provided with a cover 2, the rails are arranged on the outer circumferential surface of the cover 2, and the cover 2 is combined with the rotary wheel 6 by clamping. An axial protrusion 27 is provided on the upper end surface of the cover 2 as a rotating shaft, and a circular hole 11 for matching is provided on the upper fixing cover 1.

Figure 5:
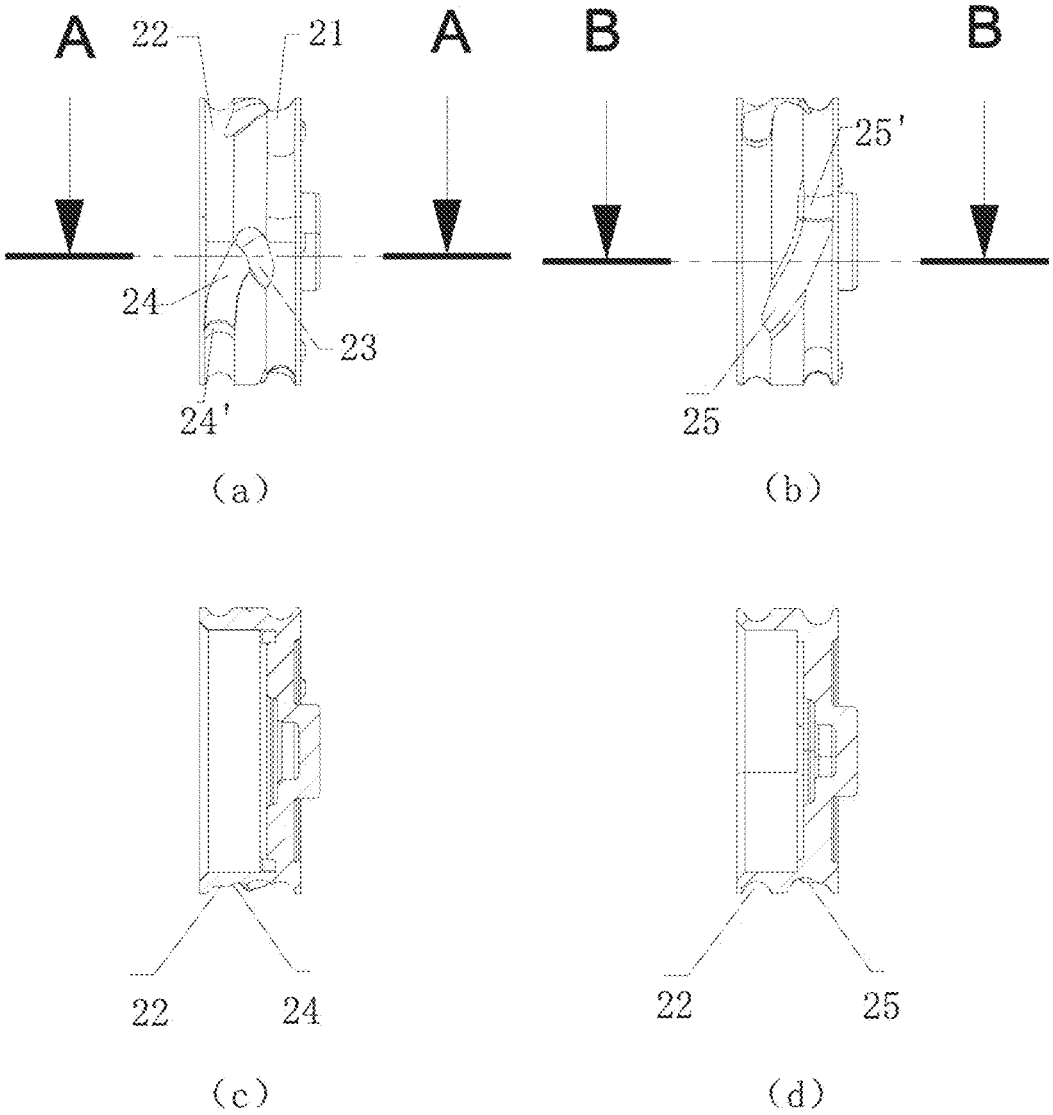
FIG. 5 (*a*) is a front view of the cover of the coil spring receiving groove.

As jointly shown in FIG. 4 and FIG. 5, two annular rails 21, 22 are disposed in parallel and located at the upper and lower sides of the outer circumference of the rotary wheel 6 respectively. At least two locking rails and at least two communicating rails 25 are provided respectively, and they are disposed alternately and evenly between two annular rails and connected with the two annular rails.

The annular rails comprise an upper annular rail 21 and a lower annular rail 22. The locking rail has a "<" shape, and comprises an upper locking rail 23 and a lower locking rail 24. The ball 3 is locked by the corner 26 of the "<" shape.

The communicating rail 25 is inclined and a direction of inclination is the same as a direction of the lower locking rail 24.

In the present embodiment, the upper annular rail 21 constitutes a retracting rail, the lower annular rail 22 constitutes an extending rail, and the height of the retracting rail is lower than that of the extending rail, so the rolling resistance of the ball in the retracting rail is minimal. Since the retracting of the cord is automatically performed by the elastic restoring force of the coil spring, this design facilitates the smooth retracting of the cord.

A smooth guiding segment 24' lower than the lower annular rail 22 is provided at the junction between the lower locking rail 24 and the lower annular rail 22. Protrusions are provided at the lower locking rail 24 and the corner 26, and at the junction between the upper locking rail 23 and the upper annular rail 21, respectively. The protrusions allow merely one-way rolling of the ball 3 in sequence along the lower annular rail 22, the lower locking rail 24, the upper locking rail 23 and the upper annular rail 21.

A smooth guiding segment 25' lower than the upper annular rail 21 is provided at the junction between the communicating rail 25 and the upper annular rail 21. A protrusion is provided at the junction between the communicating rail 25 and the lower annular rail 22. The protrusion allows merely one-way rolling of the ball 3 in sequence along the upper annular rail 21, the communicating rail 25 and the lower annular rail 22.

When the cord 7 is pulled outward, the rotary wheel 6 rotates forward and the coil spring 5 is tightened. If the starting position of the ball 3 is in the lower annular rail 22, the ball 3 keeps rolling in the lower annular rail 22, and the cord 7 is continuously wound on the rotary wheel 6. If the starting position of the ball 3 is in the upper annular rail 21, the ball 3 will rotate in the upper annular rail 21 by a distance, and then pass through the smooth guiding segment provided at the junction between the communicating rail 25 and the upper annular rail 21. Since the smooth guiding segment is lower than the upper annular rail 21, the ball 3 will enter the communicating rail 25 via the smooth guiding segment, then enter the lower annular rail 22, and remain rolling in the lower annular rail 22, and the cord 7 is continuously wound on the rotary wheel 6.

It should be noted that, if the starting position of the ball 3 is in the upper annular rail 21, and the locking rails and the communicating rails 25 are alternately and evenly arranged between the two annular rails, when the ball 3 rolls in the upper annular rail 21, it may encounter the communicating rail 25 firstly, or encounter the upper locking rail 23 firstly. If the upper locking rail 23 is encountered firstly, since a protrusion is provided at the junction between the upper locking rail 23 and the upper annular rail 21, the ball 3 will be blocked by the protrusion before entering the upper locking rail 23, so the ball 3 will continue rolling in the upper annular rail 21 until it encounters the smooth guiding segment provided at the junction between the communicating rail 25 and the upper annular rail 21 and then enter the lower annular rail 22.

Here, the distance by which the ball 3 needs to roll in the upper annular rail 21 before entering the lower communicating rail 25 depends on the number of the communicating rail 25. For example, when three communicating rails 25 are provided and evenly distributed on the annular rail, the ball 3 will roll by at most the distance of ⅓ of the annular rail before entering the communicating rail 25.

When the pulling of the cord 7 is stopped and the cord 7 is released, the elastic restoring force of the coil spring 5 drives the rotary wheel 6 to rotate backward, and the cord 7 starts to retract. The ball 3 rolls by a certain distance in the lower annular rail 22, and then passes through the smooth guiding segment provided at the junction between the lower locking rail 24 and the lower annular rail 22. Since the smooth guiding segment is lower than the lower annular rail 22, the ball 3 will enter the lower locking rail 24 through the smooth guiding segment and be stuck at the corner 26 to prevent the rotary wheel from rotating backward. When the rotation of the rotary wheel 6 is locked, the retracting of the cord 7 stops.

It should be noted that, when the ball 3 rolls in the lower annular rail 22, since the locking rails and the communicating rails 25 are alternately and evenly distributed between the two annular rails, the ball 3 may encounter the lower locking rail 24 firstly, or encounter the communicating rail 25 firstly. If the communicating rail 25 is encountered firstly, since a protrusion is provided at the junction between the communicating rail 25 and the lower annular rail 22, the ball 3 will be blocked by the protrusion before entering the communicating rail 25, so the ball 3 will continue rolling in the lower annular rail 22 until it encounters the smooth guiding segment provided at the junction between the lower locking rail 24 and the lower annular rail 22, enter the lower locking rail and be stuck at the corner 26.

In addition, the distance by which the ball 3 needs to roll in the lower annular rail 22 before entering the lower locking rail 24 depends on the number of the locking rails. For example, when three locking rails are provided and evenly distributed on the annular rail, the ball 3 will roll by at most the distance of ⅓ of the annular rail before entering the lower locking rail 24.

When the cord 7 is pulled outward again by a predetermined distance, the rotary wheel 6 rotates forward, the ball 3 enters the upper annular rail 21 from the upper locking rail 23, and the rotation of the rotary wheel 6 is unlocked. At this point the cord 7 is released, the ball 3 keeps rolling in the upper annular rail 21, and the rotary wheel 6 retracts the cord 7.

It should be noted that, when the cord 7 is pulled outward, since a protrusion is provided between the lower locking rail 24 and the corner 26, the ball 3 will be blocked by the protrusion when entering the lower locking rail 24. However, the corner 26 and the upper locking rail 23 are smoothly connected, so the ball 3 will enter the upper locking rail 23 and then enter the upper annular rail 21.

If the cord 7 is continuously pulled outward, the rotary wheel 6 rotates forward, the ball 3 enters the upper annular rail 21 from the locking rail and then enters the lower annular rail 22 via the communicating rail 25 and keeps rolling in the lower annular rail 22, and the cord 7 is continuously pulled out. When the pulling of the cord is stopped and the cord is released, the ball enters the locking rail again and the rotation of the rotary wheel 6 is locked.

Second Embodiment

The second embodiment of the present disclosure differs from the first embodiment in that, the rail wheel is sleeved on the rotary wheel 6, and the three rails are arranged on the outer circumferential surface of the rail wheel. The rail wheel is combined with the rotary wheel 6 by clamping and may rotate together with the rotary wheel 6.

The other structures of the second embodiment of the present disclosure are similar to those of the first embodiment, and will not be repeated here.

Third Embodiment

The present embodiment differs from the first embodiment and the second embodiment in that, the three rails are directly provided on the outer circumferential surface of the rotary wheel 6 without the aid of other components. However, the radial thickness of the rotary wheel 6 should be appropriately increased, and the conflict between the rails and the cover structure of the coil spring receiving groove should be avoided. This design can further reduce the radial size of the cord winding module.

The other structures of the present embodiment are similar to those of the first embodiment, and will not be repeated here.

The above description is merely preferable embodiments of the present disclosure. Based on the above teachings of the present disclosure, those skilled in the art may make other improvements or modifications on the basis of the foregoing embodiments. It should be understood by those skilled in the art that the above specific description is only for better explaining the present disclosure, and the protection scope of the present disclosure should be determined by the protection scope of the claims.

The invention claimed is:

1. A pull-out type cord winding module, comprising:

an upper fixing cover;

a lower fixing cover;

a rotary wheel which a cord is wound on and which is connected with a coil spring; and a stopper mechanism working cooperatively with the rotary wheel and including a functional rail, and a ball, wherein the functional rail comprises a locking rail, a communicating rail and annular rails, the locking rail, the communicating rail and the annular rails are connected, groove-shaped and arranged around an outer circumference of the rotary wheel;

an elastic arm is provided on the upper fixing cover, a guide groove is provided on the elastic arm, and two ends of the guide groove are located at upper and lower sides of the outer circumference of the rotary wheel respectively;

the guide groove cooperates with the functional rail to hold the ball; and when the rotary wheel rotates, the ball rolls in the functional rail to lock or unlock rotation of the rotary wheel.

2. The pull-out type cord winding module according to claim 1, wherein the functional rail is directly disposed on an outer circumferential surface of the rotary wheel;

or a rail wheel is sleeved on the rotary wheel, the functional rail is arranged on the outer circumferential surface of the rail wheel, and the rail wheel is combined with the rotary wheel by clamping;

or the rotary wheel is provided with a coil spring receiving groove, the coil spring receiving groove is provided with a cover, the functional rail is arranged on the outer circumferential surface of the cover, and the cover is combined with the rotary wheel by clamping.

3. The pull-out type cord winding module according to claim 2, wherein an axial protrusion is provided on an upper end surface of the cover as a rotating shaft, and a circular hole for matching is provided on the upper fixing cover.

4. The pull-out type cord winding module according to claim 1, wherein the guide groove has a linear shape or an arc shape.

5. The pull-out type cord winding module according to claim 1, wherein the number of the annular rails is two and the two annular rails are located at the upper and lower sides of the outer circumference of the rotary wheel respectively;

the number of the locking rail and the number of the communicating rail are both at least two, the locking rails and the communicating rails are disposed alternately and evenly between two annular rails and connected with the two annular rails; and the annular rails comprise a retracting rail and an extending rail, and the height of the retracting rail is lower than that of the extending rail.

6. The pull-out type cord winding module according to claim 5, wherein the annular rails comprise an upper annular rail and a lower annular rail;

the locking rail has a shape of math symbol "<" used to denote "less than", and comprises an upper locking rail and a lower locking rail, and the ball is locked by a corner of the shape "<"; and the communicating rail is inclined, and the direction of inclination is the same as the direction of the lower locking rail.

7. The pull-out type cord winding module according to claim 6, wherein a smooth guiding segment lower than the lower annular rail is provided at a junction between the lower locking rail and the lower annular rail;

protrusions are provided at the lower locking rail and the corner, and at a junction between the upper locking rail and the upper annular rail, respectively; and the protrusions allow merely one-way rolling of the ball in sequence along the lower annular rail, the lower locking rail, the upper locking rail and the upper annular rail.

8. The pull-out type cord winding module according to claim 7, wherein a smooth guiding segment lower than the upper annular rail is provided at a junction between the communicating rail and the upper annular rail;

a protrusion is provided at a junction between the communicating rail and the lower annular rail; and the protrusion allows merely one-way rolling of the ball in sequence along the upper annular rail, the communicating rail and the lower annular rail.

9. The pull-out type cord winding module according to claim 8, wherein when the cord is pulled outward, the rotary wheel rotates forward and tightens the coil spring, and the ball keeps rolling in the lower annular rail; or, the ball enters the lower annular rail from the upper annular rail via the communicating rail, and keeps rolling in the lower annular rail; and when the pulling of the cord is stopped, the coil spring drives the rotary wheel to rotate backward, the ball enters the locking rail from the lower annular rail and is stuck at the corner to prevent the rotary wheel from rotating backward, and the rotation of the rotary wheel is locked.

10. The pull-out type cord winding module according to claim 9, wherein when the cord is pulled outward again by a predetermined distance, the rotary wheel rotates forward, the ball enters the upper annular rail from the locking rail, and the rotation of the rotary wheel is unlocked; at this point the cord is released, the ball keeps rolling in the upper annular rail, and the rotary wheel retracts the cord;

or, when the cord is continuously pulled outward again, the rotary wheel rotates forward, and the ball enters the upper annular rail from the locking rail and then enters the lower annular rail via the communicating rail and keeps rolling in the lower annular rail.

* * * * *